US005402566A

United States Patent [19]

Long

[11] Patent Number: 5,402,566

[45] Date of Patent: Apr. 4, 1995

[54] METHOD AND MACHINE FOR ATTACHING AN ELECTRICAL CONNECTOR TO A COAXIAL CABLE

[75] Inventor: Alden O. Long, Carlisle, Pa.

[73] Assignee: The Whitaker Corporation, Wilmington, Del.

[21] Appl. No.: 223,478

[22] Filed: Apr. 4, 1994

[51] Int. Cl.[6] ..... H01R 43/04; B23P 19/00

[52] U.S. Cl. ..... 29/863; 29/753; 29/828; 174/88 C

[58] Field of Search ..... 174/88 C; 29/828, 862, 29/753, 33 M

[56] References Cited

U.S. PATENT DOCUMENTS

| | | | |
|---|---|---|---|
| 3,484,936 | 12/1969 | Schwalm et al. | 29/862 X |
| 3,621,560 | 11/1971 | Le Bright | 29/828 |
| 4,268,957 | 5/1981 | Sbuelz . | |
| 4,712,296 | 12/1987 | Forney, Jr. et al. | 29/828 |
| 5,230,640 | 7/1993 | Tardit | 174/88 CK |

FOREIGN PATENT DOCUMENTS

| | | | |
|---|---|---|---|
| 3-182077 | 8/1991 | Japan | 29/828 |

*Primary Examiner*—Carl J. Arbes

[57] ABSTRACT

A machine and method are disclosed for attaching a coaxial connector to the end of a coaxial cable. The machine seats the cable end having a preassembled contact into the connector housing, latching the contact in place, then conducts a pull test to verify proper latching. The jaws that grip the cable during insertion of the contact and pull testing are used to push the ferrule over the braided signal conductor prior to crimping the ferrule. A single air cylinder is used, at a relatively low pressure, to seat the contact and at a relatively high pressure to seat the ferrule. A constant force return spring is used to apply a predetermined test force to the jaws during the pull test. A high voltage test may be conducted at two points in the operating cycle.

16 Claims, 10 Drawing Sheets

A
B
10
40
42
46
48
60
86
102
110
180
202
230

284

C
D 102
102
76
82
74
84
60
180
126
90
86
54
92
46
50
58
48
42
44
5

METHOD AND MACHINE FOR ATTACHING AN ELECTRICAL CONNECTOR TO A COAXIAL CABLE

The present invention is related to electrical connectors for coaxial cables and more particularly to machines for attaching such connectors to the cable and then testing the attachment to assure compliance to desired standards.

BACKGROUND OF THE INVENTION

High precision coaxial cable, such as RG-58, is usually terminated to coaxial connectors by hand to produce high quality coaxial cable assemblies. The connector, in the present example a right angle connector AMP part number 477651-5, consists of three loose parts that must be assembled to the cable end, a contact terminals, ferrule, and connector body. The end of the cable is first stripped back to a specified length to expose the center conductor and the outer shield conductor. The loose contact terminal is then crimped to the end of the center conductor, The ferrule is then slipped over the end of the cable until it is over the outer jacket, adjacent the stripped end. The braided shield conductor is then flared and the contact terminal is inserted into the connector body until the inner dielectric layer enters the body and the flared shield conductor is over the knurled portion of the connector body. At this point the cable is further inserted into the connector body until the contact terminal is seated and latched in the connector. The cable and connector body are then pulled in opposite directions slightly to verify that latching has occurred This is a somewhat delicate operation to perform by hand and requires substantial skill because the components are small and delicate and are easily damaged. The ferrule is then slid over the braided shield conductor causing it to be trapped between the inside of the ferrule and the outside of the knurled portion of the connector body. This step is difficult to do manually because it takes from about 5 to 10 pounds and may take up to as much as 25 pounds of force to slide the ferrule into position. The partial assembly is then positioned in a crimping machine and the ferrule crimped in place. The terminated end of the cable is then manually tested for electrical continuity and high voltage breakdown, and if it meets specific standards, the other end of the cable is terminated to a connector in a similar way. It will be appreciated that this procedure is highly labor intensive, requiring a high level of skill. What is needed is to automate the steps of the procedure that are difficult to perform manually and to provide a more reliable and uniform final product at a substantial cost savings.

SUMMARY OF THE INVENTION

A machine is disclosed for attaching an electrical connector to the end of a coaxial cable and then testing the effectiveness of the attachment. The connector has a contact and a ferrule that are preassembled to the cable. The machine includes a frame and a crimping apparatus attached to the frame having tooling arranged to crimp the ferrule of the connector to the cable end. A carriage is coupled to the frame and arranged to move to a first position adjacent the jaws of the crimping apparatus and to a second position away from the jaws. Holding means is attached to and carried with the carriage for holding and positioning the connector in position for crimping by the tooling when the carriage is in the first position. Clamping means is provided that is movable in a first direction toward the holding means substantially parallel with the longitudinal axis of the cable and in a second direction away from the holding means. The clamping means includes a pair of jaws movable to any of first, second, and third positions. In the first position it is in clamping engagement with the cable for inserting the contact into latching position within the connector when the clamping means is moved in the first direction and to test the effectiveness of the latching when moved in the second direction. In the second position it is adjacent the outer periphery of but not clamping the cable for abutting against an end of the ferrule and moving the ferrule into assembled position with respect to the cable and the connector when the clamping means is moved in the first direction. In the third position it is spaced from the cable. A control means is provided for effecting the movements of the carriage, the clamping means. and the pair of jaws to effect the attachment of the connector to the cable.

DESCRIPTION OF THE FIGURES

FIG. 6A is a plan view of the machine shown in FIG. 4A;

DESCRIPTION OF THE PREFERRED EMBODIMENT

Figure 1:
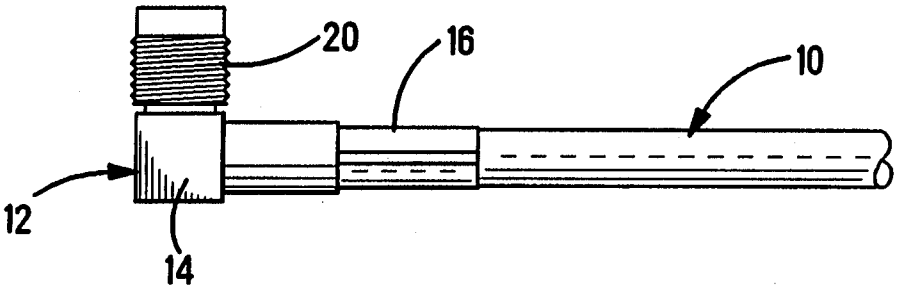
FIG. 1 is a view of a coaxial cable assembly of the type that is processed by a machine incorporating the teachings of the present invention.
Figure 2:
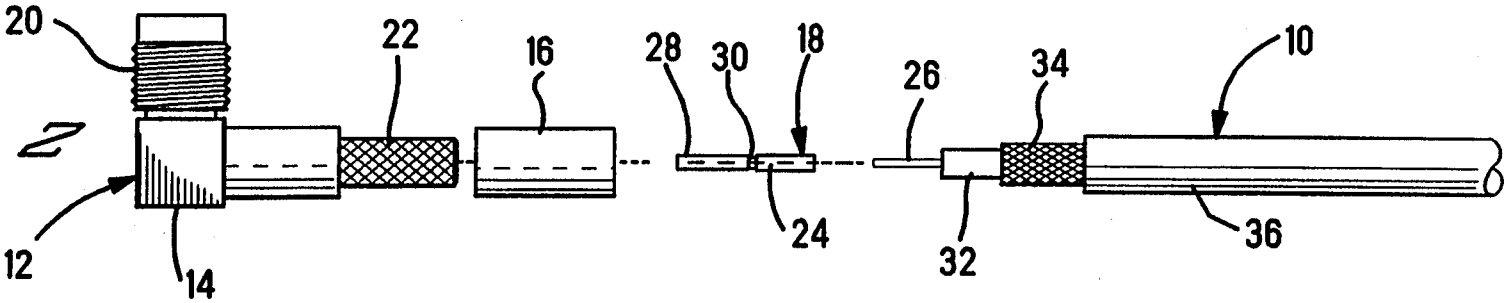
FIG. 2 is an exploded parts view of the cable assembly shown in FIG. 1.
Figure 3:
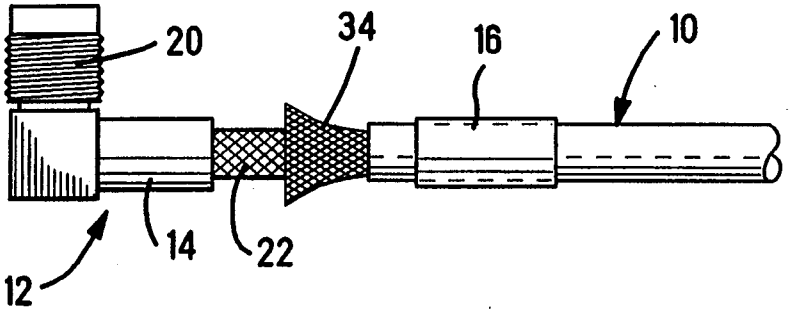
FIG. 3 is a view of the cable assembly of FIG. 1 shown partially assembled.

There is shown in FIGS. 1 and 2 a coaxial cable 10 and attached connector 12, of the type assembled by the machine of the present invention. The cable 10, in the present example is an RG-58 high precision coaxial cable that is well known in the industry. As shown in FIG. 2, the connector 12, AMP connector part number 477651-5 in the present example, is composed of three separate parts that must be assembled during attachment to the cable 10. The connector 12 includes a connector body 14, a ferrule 16, and a contact terminal 18. The connector body 14 has a threaded end 20 for mating with a mating coaxial connector and a barrel 22 having a knurled outer diameter to which the shield conductor of the cable 10 is to be terminated. The contact 18 has an opening 24 for receiving a striped center conductor 26 of the cable 10 and is arranged to be crimped to the center conductor. The other end 28 of the contact terminal 18 is arranged to mate with a contact, not shown, within the connector body 12 when the contact terminal is inserted into the interior of the barrel 22. A groove 30 on the contact engages a rib in the connector body 14 to latch the contact terminal when properly seated. The cable 10 includes a dielectric material 32 encircling the center conductor 26 and a braided shield conductor 34 encircling the outer diameter of the dielectric material, and an insulating outer jacket 36. The ferrule 16 has an inner diameter that is sized to just slip over the cable jacket 36. The barrel 22 has an inner diameter that is sized to receive the dielectric 32 yet with a wall thin enough to allow the braided shield conductor to slip over the knurled outer diameter. When assembling, the braided shield conductor is usually flared out by hand a small amount to allow it to easily slip over the knurled barrel 22. The ferrule 16 that has been previously slipped over the jacket 36 can then be slid over the braided shield conductor and crimped in place thereby securing the shield conductor firmly to the knurled barrel 22. The cable 10 and connector 12 are partially assembled, as shown in FIG. 3, and then positioned in the machine of the present invention which automatically completes the assembly and performs certain tests to assure proper assembly. The machine of the present invention will now be describe in detail.

There is shown in FIGS. 4A, 4B, 4C, 4D, 6A, 6B, and 6C a machine 40 for attaching an electrical connector 12 to a coaxial cable 10. The machine 40 has a frame or base plate 42, a crimping apparatus 44 attached to the base plate, and a carriage 46 arranged to present the cable and connector assembly to the crimping apparatus for crimping. The crimping apparatus 44 including an angular motions actuator 48, an L-shaped mounting bracket 50 attached to the base plate 42 by screws 52, and a pair of interengaged tooling bars 54 that cooperate to provide parallel motion to crimping dies 56 formed on their opposing ends. The actuator 48 includes an air cylinder 58 and a pair of jaws 60 which are pivotally attached to the frame of the actuator and caused to pivot by extension or retraction of the piston rod of the air cylinder. As the jaws 60 are pivoted first in one direction and then the other, the interengaged tooling bars 54 are made to move so that the dies 56 move together for crimping and in an opposite direction away from each other for removing the completed cable assembly and for loading another cable and connector into position for crimping.

Figures 4, 4A, 4B, 4C, 4D:
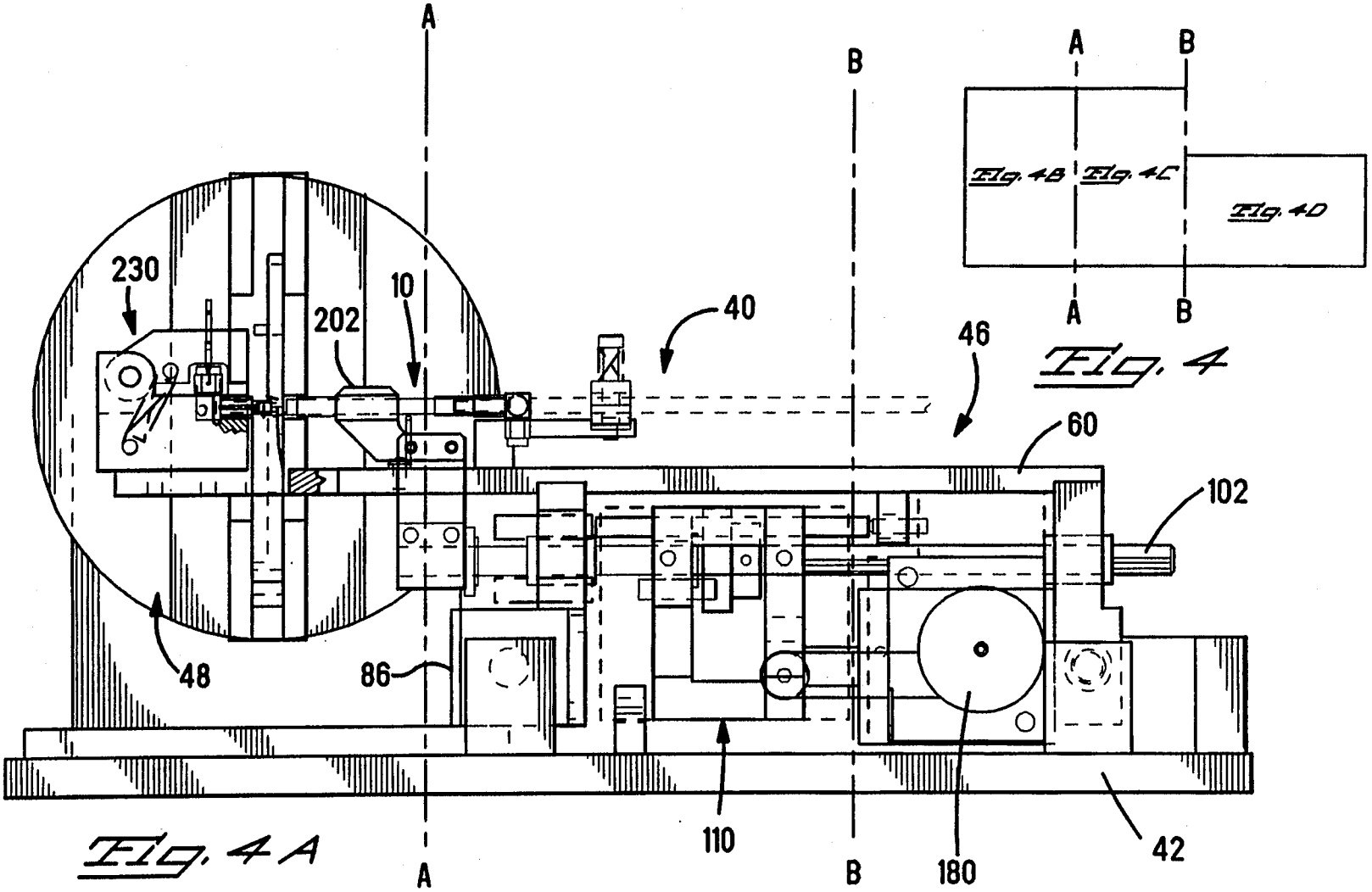
FIG. 4 is a diagram of a front view of the machine shown in FIG. 4A.
FIG. 4A is a front view of a machine incorporating the teachings of the present invention.
FIG. 4B is an enlarged view of a first portion of that shown in FIG. 4A and as indicated in FIG. 4.
FIG. 4C is an enlarged view of a second portion of that shown in FIG. 4A and as indicated in FIG. 4.
FIG. 4D is an enlarged view of a third portion of that shown in FIG. 4A and as indicated in FIG. 4.
Figure 4B:
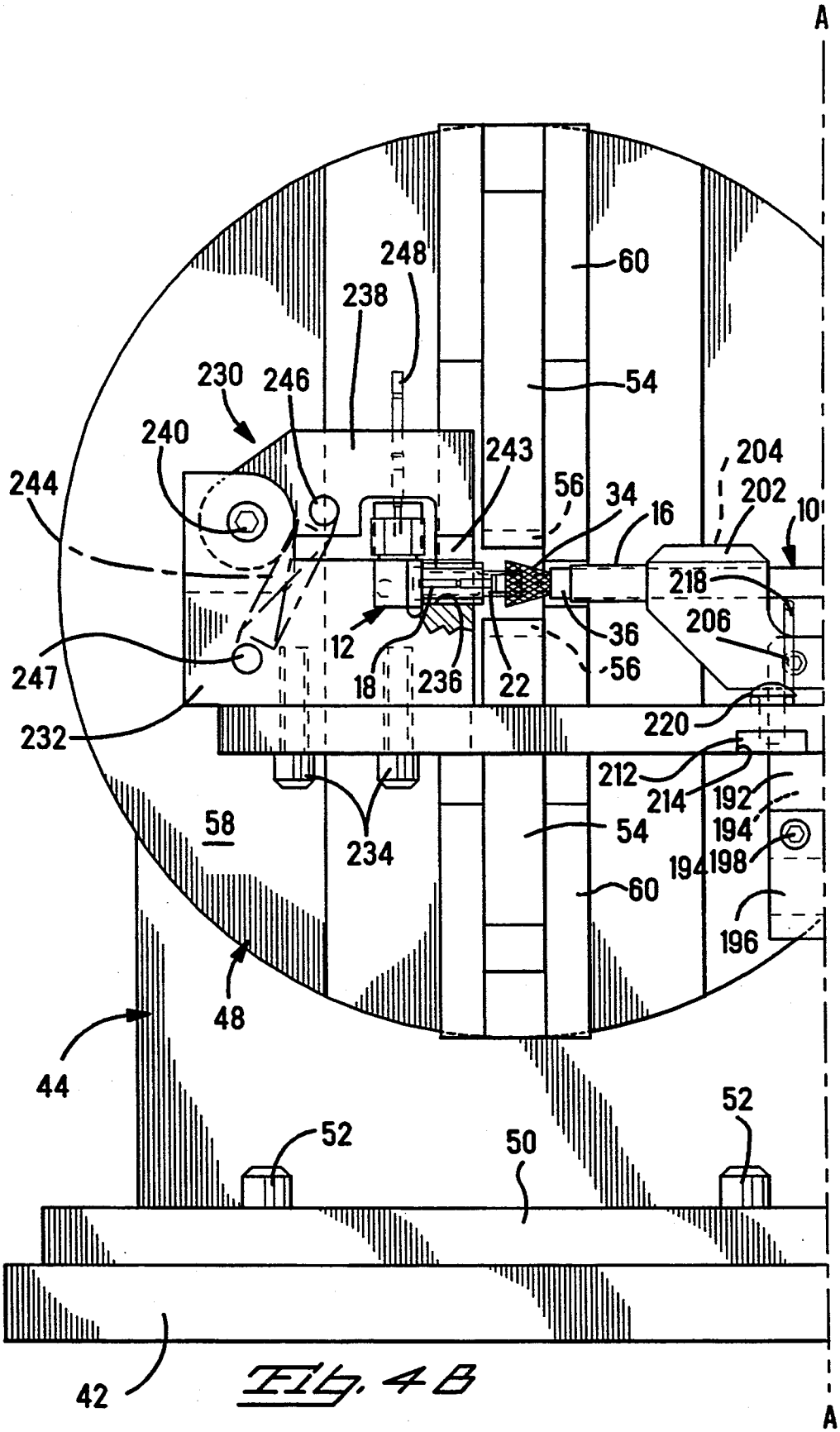
Figure 4C:
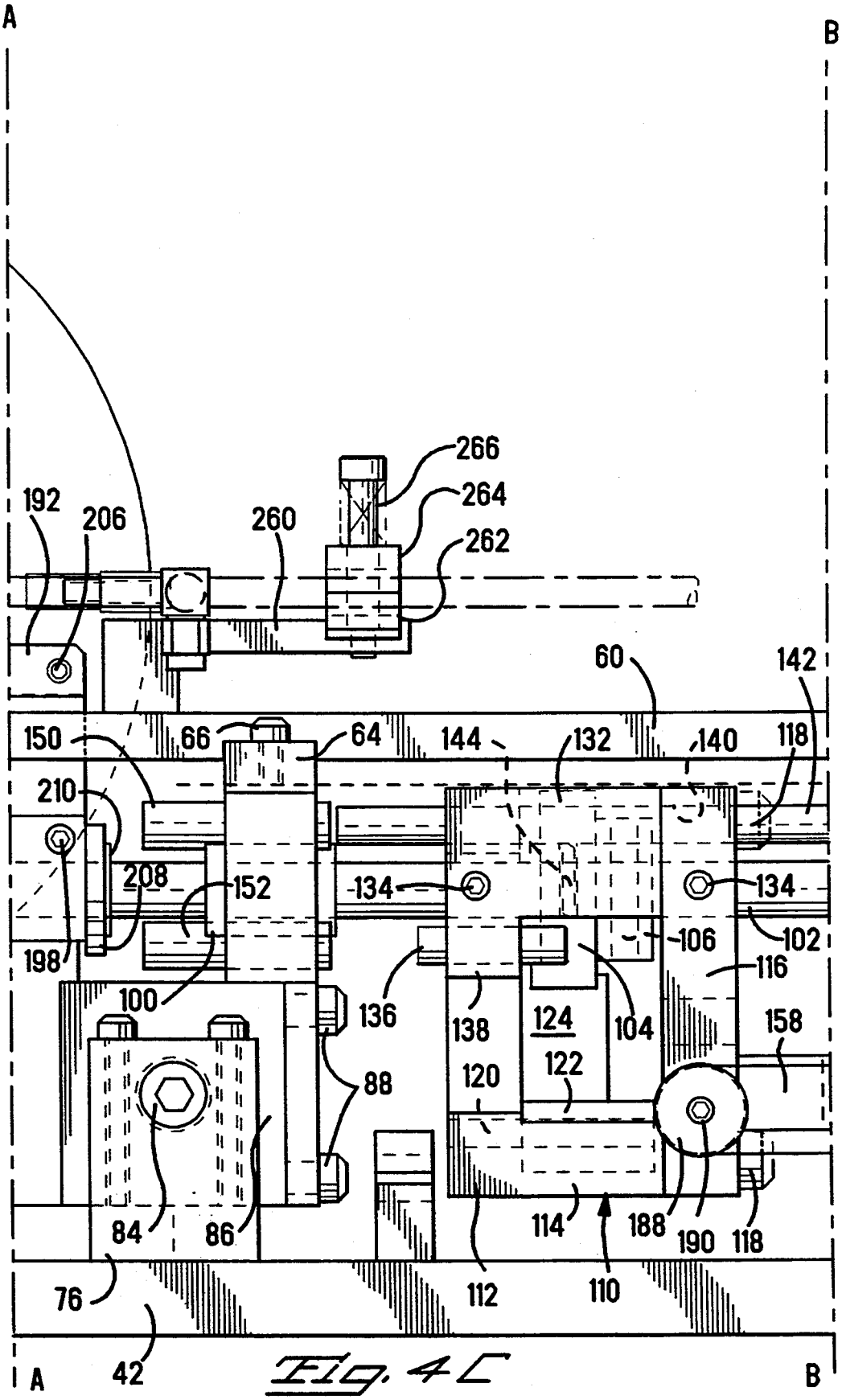
Figure 4D:
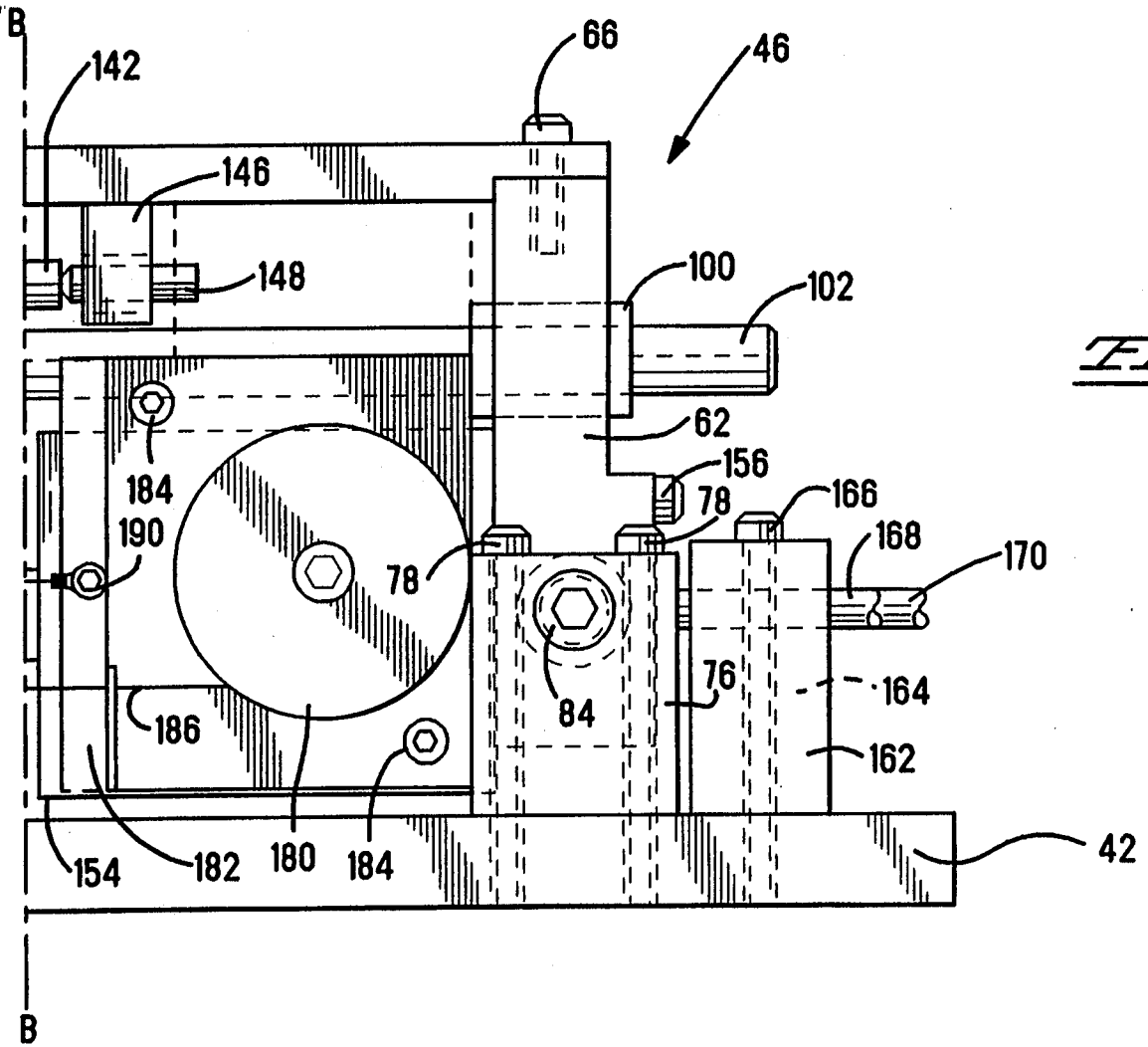
Figure 5:
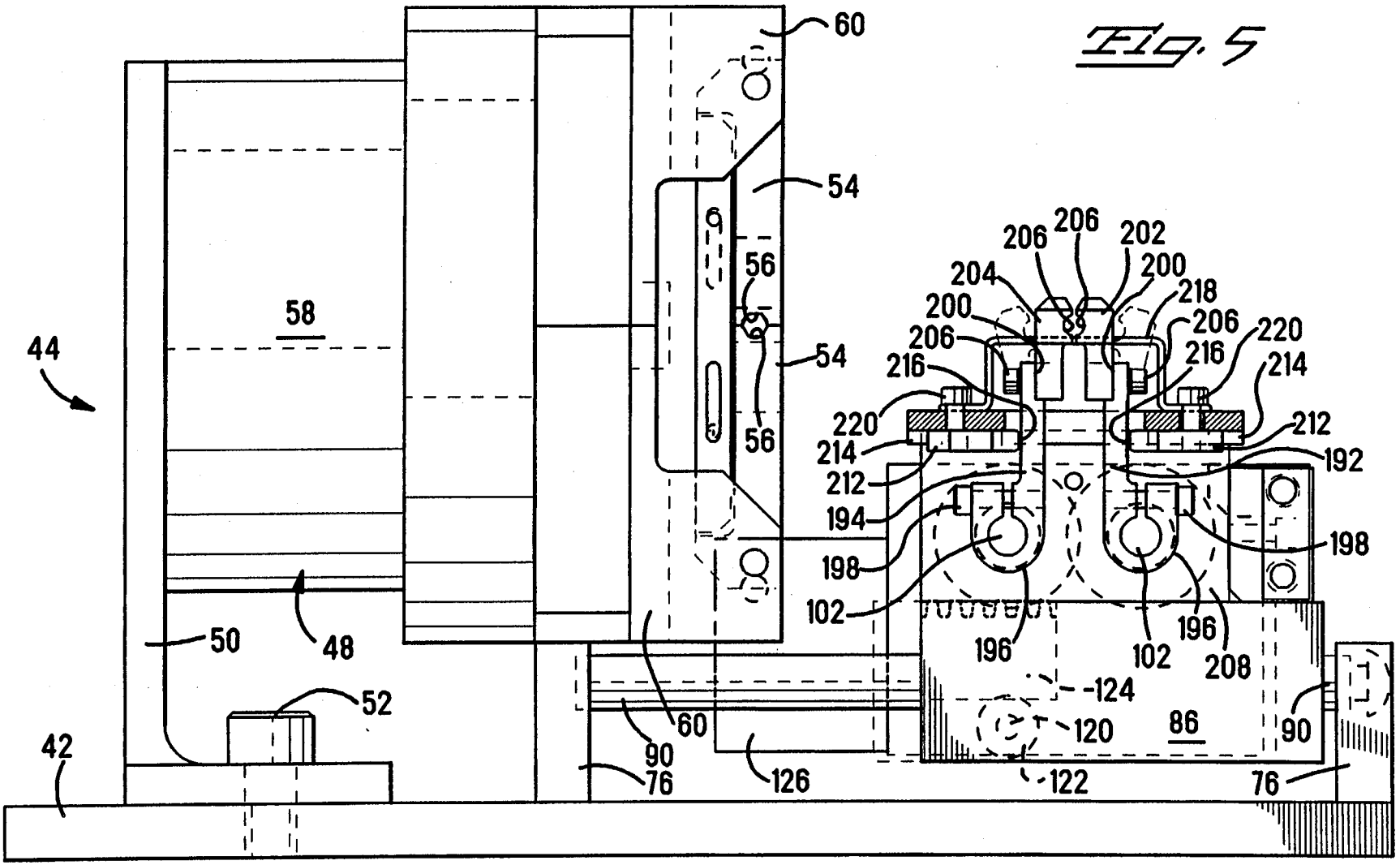
FIG. 5 is a cross-sectional view of the machine taken along the lines 5—5 as shown in FIG. 6.
Figures 5A, 5B, 5C, 6:
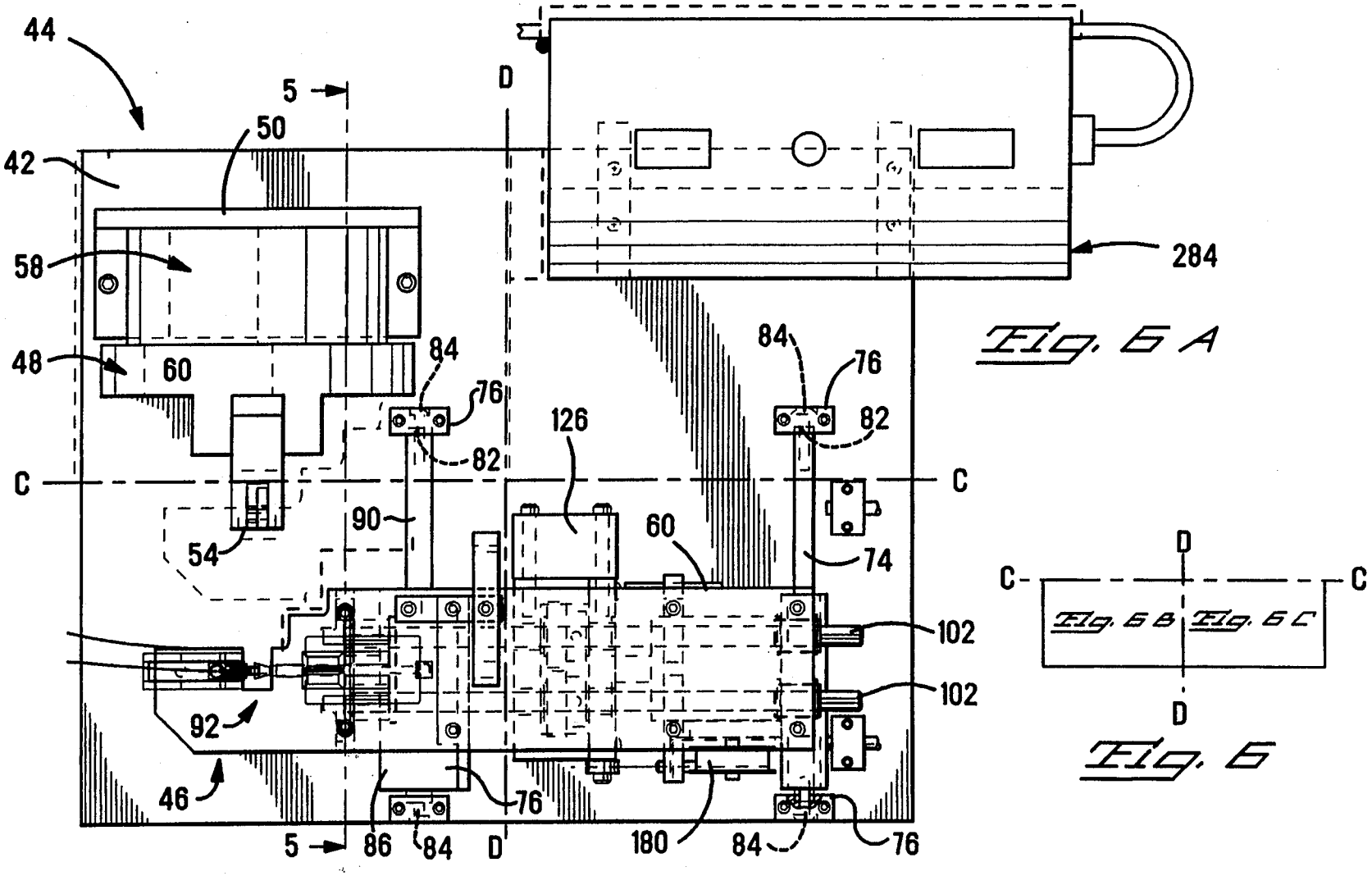
FIG. 6 is a diagram of a front view of the machine shown in FIG. 6A.
Figure 6B:
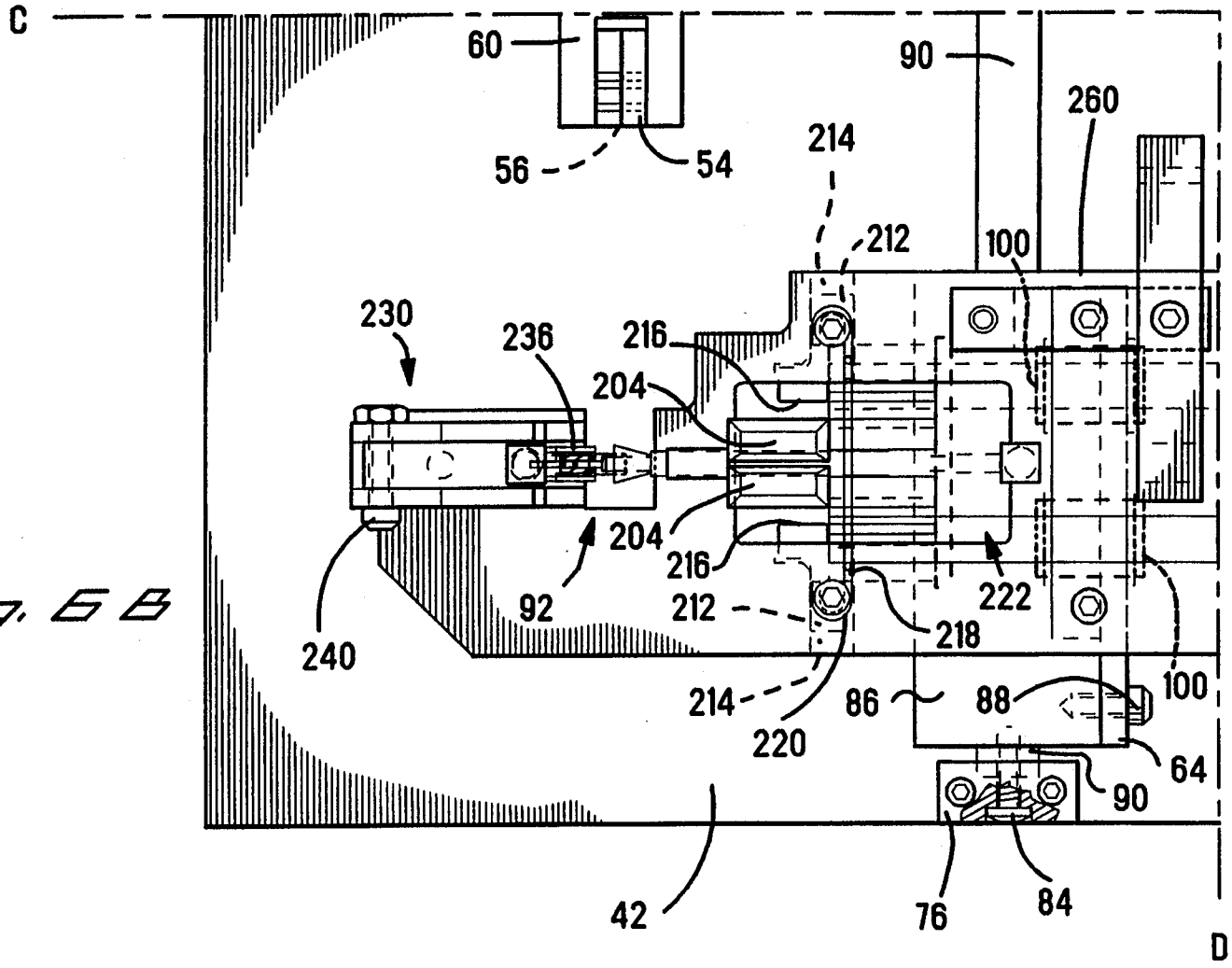
FIG. 6B is an enlarged view of a first portion of that shown in FIG. 6A and as indicated in FIG. 6.

The carriage 46 has a top plate 60, a right support 62 and a left support 64, both of which are fitted into rabbets in the bottom of the top plate and held in position by screws 66. The right support 62 has a hole 68 bored therethrough and a counterbore 70 in each end thereof. A linear ball bushing 72 is arranged in each counterbore 70, in mutual axial alignment. A mating shaft 74, sized to be a rolling slip fit along the axes of the two ball bushings, is disposed therein and supported at each end by a support block 76 that is attached to the base plate 42 by the screws 78. Each support block 76 has a through hole 80 and an inwardly facing counterbore 82 sized for a slip fit with the end of the shaft 74. Each end of the shaft 74 is held in its respective counterbore 82 by means of a button head screw 84 threaded into the end of the shaft. The other end of the top plate 60 is supported by the left support 64 which is attached to the frame of an air cylinder 86 by means of the screws 88. The air cylinder 86 has a piston rod 90 that extends completely through the cylinder housing and into counterbores 82 formed into a second pair of support blocks 76 that are attached to the base plate 42 with the screws 78, as best seen in FIG. 4C and 6A. Each end of the piston rod 90 is held in its respective counterbore 82 by means of a button head screw 84 threaded into the ends of the piston rod in a manner similar to that of the shaft 74. The axes of the piston rod 90 and the shaft 74 are parallel. Since the piston rod 90 is held stationary with respect to the base plate 42, when the air cylinder 86 is actuated, its frame moves along the axis of the piston rod, carrying the top plate 60 along with it. During this movement the linear ball bushings 72 slide along the shaft 74 thereby supporting the end of the top plate 60. As best seen in FIG. 6B, the top plate 60 includes a workstation 92 that is in alignment with the crimping dies 56 and arranged so that when the air cylinder 86 is actuated in a first direction the top plate 60 is moved so that the workstation moves to a first position or crimping position adjacent the crimping dies, as shown in phantom lines in FIG. 6A. When the air cylinder is actuated in an opposite direction the workstation is made to move away from the crimping dies to a second position that is its load position shown in solid lines in FIG. 6A.

Figure 6C:
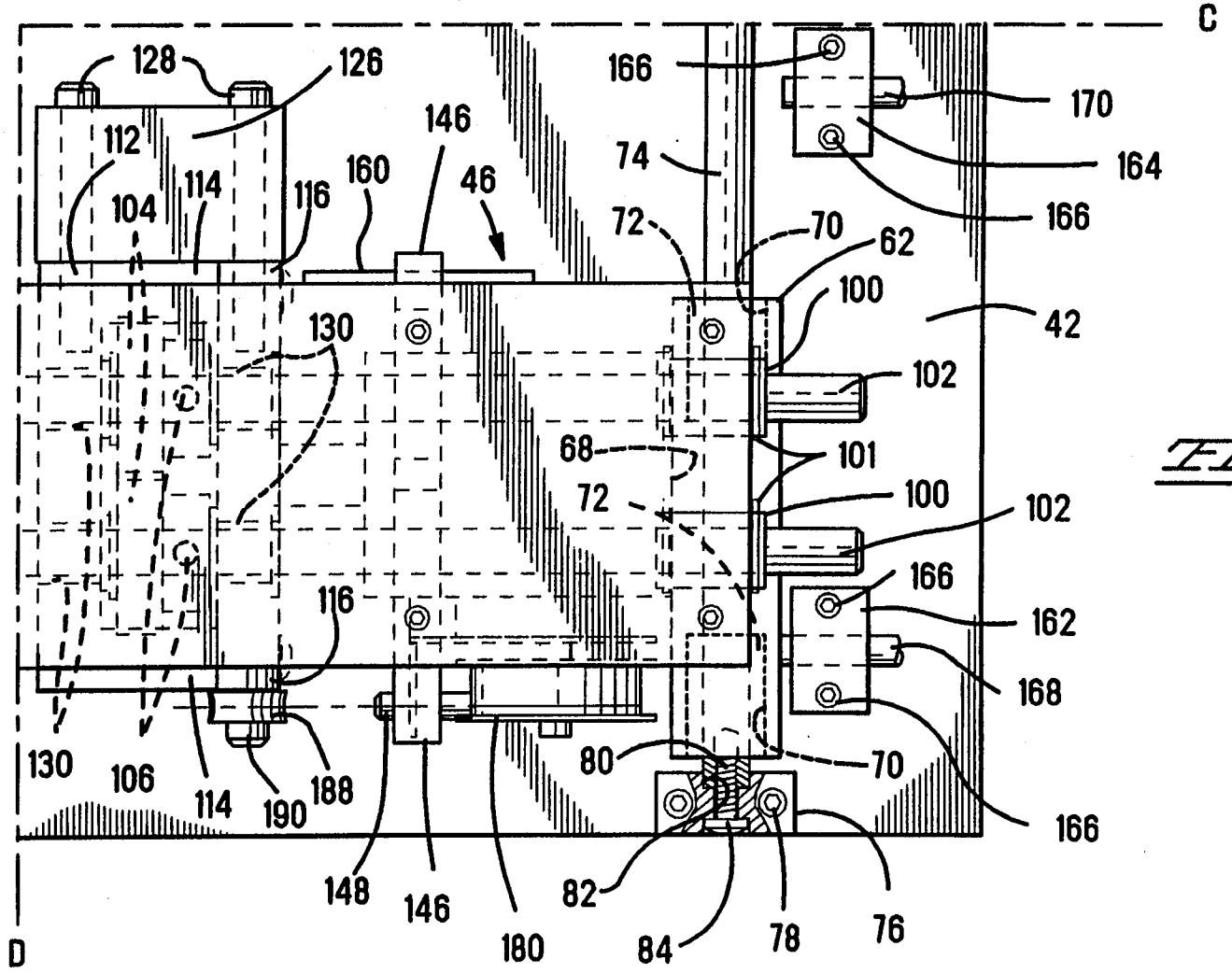
FIG. 6C is an enlarged view of a second portion of that shown in FIG. 6A and as indicated in FIG. 6.

The right and left supports 62 and 64, respectively, each have a pair of linear ball bushings 100 that are a slip fit in bores formed in the supports so that the two bushings in each pair are in alignment with the bushings of the other pair. As best seen in FIG. 6B and 6C, each bushing 100 includes a pair of grooves, one groove near each end, that contain retaining rings 101 for holding the bushing in its respective bore. Two shafts 102 extend through these two pairs of ball bushings and are sized to be a rolling slip fit within the bushings and are free to rotate as well as to move axially with respect to the supports 62 and 64. A pair of mating spur gears 104 are attached to the two shafts 102 by means of roll pins 106 in the usual manner, and are arranged so that when one gear 104 rotates its shaft 102 in one direction, the other gear rotates its shaft in the opposite direction. A box housing 110 is arranged to partially enclose the two spur gears 104. The box housing includes a left plate 112 having four legs 114 extending outwardly, each leg having a taped hole therein. A right plate 116 is attached to the ends of the legs 114 by means of screws 118 being threaded into the taped holes, as best seen in FIG. 4C, thereby trapping the two spur gears therebetween. A pin 120 is pressed into a hole in the left plate 112 and extends toward and into a support hole in the right plate 116. A roller 122 is journaled for rotation on this pin. A rack gear 124 is in mated engagement with one of the spur years 104 and is vertically supported, as viewed in FIG. 4C, by the roller 122. As best seen in FIG. 6C, an air cylinder 126 is attached to the left and right plates 112 and 116 by two screws 128 and positioned so that its piston rod is in alignment with the rack gear 124. A threaded stud, not shown, is threaded into holes in both the rack gear and the end of the piston rod to secure them together. As the air cylinder 126 is actuated to extend its piston rod, the rack gear 124 moves to the right, as viewed in FIG. 5, causing the left most shaft 102 to rotate counterclockwise and the right most shaft to rotate clockwise. When the piston rod is retracted, the rack gear moves to the left and the two shafts 102 are rotated in opposite directions. The left and right plates 112 and 116 each have a pair of oil impregnated bronze bushings 130 pressed into holes therein, in alignment with the two shafts 102 so that the shafts are free to rotate yet are axially fixed to the box housing 110 by virtue of the two spur gears 104 being trapped between the left and right plates 112 and 116. The box housing 110, the shafts 102, and the two spur gears 104 are free to move as an assembly, back and forth in a direction parallel with the axes of the shafts. A sensor block 132 is attached to the left and right plates 112 and 116 by means of screws 134. A sensing screw 136 is threaded into a hole in a downwardly directed flange 138 for a purpose that will be explained below. A bore 140 is formed through the sensor block 132, as best seen in FIG. 4C, and has a shaft 142 sized to be a slip fit with the bore extending outwardly from both sides of the sensor block. A ball plunger 144 is arranged in a threaded hole in the sensor block 132 that intersects the bore 140. This ball plunger acts as a drag to dampen axial movement of the shaft 142 within the bore 140 due to vibration during operation of the machine 40. A block 146 is attached to the under side of the top plate 60 and has a sensor screw 148 threaded into a hole formed therein in alignment with the bore 140 in the sensor block 132 and serves to limit movement of the shaft 142 in one direction. A pair of proximity sensors 150 and 152 are arranged in bores in the left support 64 so that their axes are in alignment with the axes of the shaft 142 and the sensing screw 136, respectively. The sensor 150 senses proximity of the end of the shaft 142 while the sensor senses proximity of the end of the sensing screw 136 during operation of the machine, as will be explained below. An air cylinder 154 is attached to the inside surface of the right support 62, as best seen in FIGS. 4D and 5, by means of screws 156 that engage threaded holes in the frame of the air cylinder. The air cylinder has a piston rod 158 that extends toward the right plate 116 and is shown in abutting engagement therewith in FIG. 4C. The air cylinder 154 may be actuated to withdraw its piston rod 158 further to the right so that it is spaced from the plate 116, and the piston rod may be further extended to move the box housing 110 and its captive shafts toward the left. A third proximity sensor 160 is arranged in a bore in the block 146, as best seen in FIG. 6C, that detects the presents of the box housing 110 in its right most position. A pair of sensor mounting blocks 162 and 164 are secured to the base plate 42 by means of the screws 166. Fourth and fifth proximity sensors 168 and 170 are arranged with one sensor in each mounting block, as shown in FIG. 6C. The sensor 170 detects when the carriage 46 has moved so that the workstation 92 is in crimping position adjacent the cringing dies 56, shown in phantom in FIG. 6A, while the sensor 168 detects when the carriage is in its position shown in solid lines. A constant force return spring reel 180 is attached to a mounting bracket 182 by means of screws 184 and the bracket is securely attached to the right support 62 by means of screws that are not shown. The return spring reel 180, in the present example, is part number ML3949, manufactured by AMETEK of Sellersville, Pa., and has a cable 186 with a constant pulling force of 1.25 to 1.5 pounds when extended to about 12 inches. A small pulley 188 is coupled to the side of the right plate 116, as best seen in FIG. 4C, by means of a screw 190 that is threaded into the plate. The pulley 188 in journaled for rotation on the screw. The cable 186 is directed about the pulley 188 and the end of the cable secured to a screw 190 that is threaded into a hole in the mounting bracket 182. With this arrangement, the return spring reel 180 applies a constant force of 2.0 to 3.0 pounds on the box frame 110 urging it in a direction toward the air cylinder 154.

As shown in FIGS. 4B and 5, right and left oppositely formed arms 192 and 194 are arranged on the ends of the shafts 102 that extend past the left support 64. Each arm 192, 194 has a split flange 196 with a bore therethrough that is a slip fit with the shaft 102. A locking screw 198 is threaded into one side of each of the flanges 196 to securely lock it to its respective shaft 102. The upper ends of the arms 192 and 194 have rabbets 200 for receiving opposing gripping jaws 202 and 204 which are secured in place by the screws 206. Each of the gripping jaws 202, 204 has a half round groove 206 that conforms to the outside diameter of the cable 10. The two grooves 206 are in opposing relationship so that when the two arms 192 and 194 are in their closed position, shown in FIG. 5, the outside diameter of the cable is securely held within the two grooves. As discussed above, the two spur gears 104 are pinned to their respective shafts 102 so that when the air cylinder 126 is actuated to move the rack gear 124 to the right, as viewed in FIG. 5, the two spur gears are made to rotate thereby causing the arms 192 and 194 to pivot along with their shafts 102 so that the two jaws 202 and 204 move away from each other to an open position shown in phantom lines in FIG. 5. When the air cylinder 126 moves the rack gear 124 to the left, as viewed in FIG. 5, the two spur gears and their shafts rotate in the opposite direction causing the two jaws to move toward each other into their closed position shown in solid lines. When the jaws 202 and 204 are closed on a cable 10 there are forces tending to cause the two shafts 102 to separate, therefore, a plate 208 having a pair of spaced holes formed therethrough on centers corresponding to the centers of the two shafts 102 and being a slip fit with those shafts, is arranged adjacent the two flanges 196 of the arms. This holds the two shafts 102 in alignment during operation. The plate 208 is held in place adjacent the flanges by means of a pair of retaining rings 210 that are arranged in grooves in the shafts in the usual manner. A pair of L-shaped guide members 212 are arranged in slots 214 formed in the bottom of the top plate 60, as shown in FIGS. 4B, 5, and 6B, and have guide surfaces 216 that are space apart so that the two arms 192 and 194 will just slide therebetween with a small amount of clearance when the jaws 202 and 204 are in their closed position. A U-shaped wire 218 is arranged to support the cable 10 and position it to be received within the grooves 206 of the jaws 202 and 204. The wire 218 includes loops formed at each end through which screws 220 are received. The screws 220 pass through clearance holes in the top plate 60 and are threaded into holes in the two L-shaped guide members 212 to hold the guide members and the U-shaped wire in place. A rectangular opening 222 is formed through the top plate 60 for clearance for the two arms 192 and 194 that extend upwardly therethrough.

As shown in FIGS. 4B and 6B, a connector clamp 230 is arranged to receive and position the connector 12 in preparation for attachment to the end of the cable 10. The connector clamp 230 includes a base 232 that is attached to the upper surface of the top plate 60 by means of screws 234 that are threaded into holes in the base. The base 232 includes a nest 236 for accurately positioning the connector 12 with respect to the crimping dies 56. A hold down arm 238 is pivotally attached to the base 232 by a shoulder screw 240 and nut. The arm 238 includes a connector engaging end 242 that engages one side of the connector 12, seating it into the nest 236. A hold down spring 244 is arranged between pins 246 and 247 extending from the base 232 and the arm 238, respectively, as best seen in FIG. 4B. The spring 244 securely holds the connector 12 in place during the crimping operation. The arm 238 includes a probe 248 that extends through the arm and electrically engages the center contact of the connector 12 for performing electrical tests on the cable connector assembly. When removing the connector 12 or when seating another connector in the nest 236. The arm 238 is pivoted counterclockwise to remove the connector 12 from the nest. A second cable support is provided for relatively long cables and includes a bracket 260 secured to the upper surface of the top plate 60 by any suitable means and a clamping arm 262 attached to the bracket 260 and a movable clamping arm 264 that is spring loaded toward the fixed arm. A nest is provided in opposing surfaces of the two clamping arms to clampingly receive the cable 10. When using the second cable support, tile movable arm 264 is manually moved against the force of the spring to open the nest so that the cable can be inserted and then released.

Figure 7:
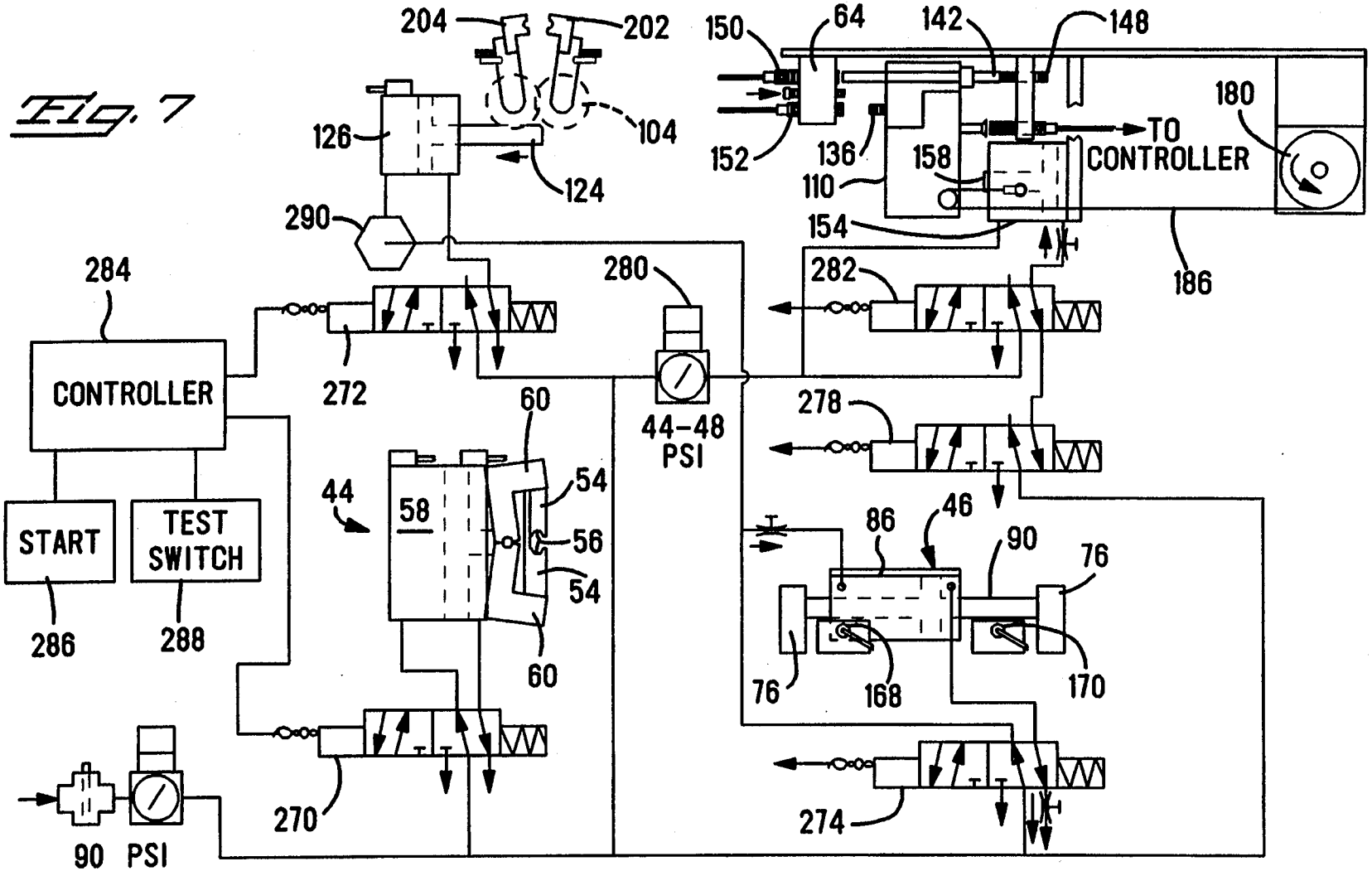
FIG. 7 is a schematic diagram illustrating the major functional components of the machine shown in FIG. 4.

The operation of the machine 40 will now be described with reference to the schematic diagram of FIG. 7 as well as FIGS. 4A, 4B, 4C, 4D, 5, 6A, 6B and 6C. As shown in FIG. 7, the gripper jaws 202 and 204 are in their open position, the piston rod 158 of the air cylinder 154 is fully retracted so that the cable 186 of the constant force return reel 180 has pulled the box housing 110 to its right most position, and the carriage. 46 is in its load position, as shown in solid lines in FIG. 6A. Note also that the piston rod of the air cylinder 58 is extended so that the crimping dies 56 are open. The end of a coaxial cable 10 is striped as shown in FIG. 2 and a contact terminal 18 is crimped onto the center conductor 26 in the usual manner. A ferrule 16 is then slid over the outer jacket 36 to the position shown in FIG. 3. The braided shield conductor 34 is then manually flared a small amount and the contact 18 and the dielectric 32 inserted into the connector housing 14 until the flared braided shield conductor has slipped over a portion of the knurled barrel 22 to the position shown in FIG. 3. The partially assembled cable and connector are then loaded into the machine 40 by carefully laying the connector 12 in the nest 236 with the cable resting between the two jaws 202 and 204 on the wire cable support 218, and closing the hold down arm 238, as shown in FIGS. 4B, 4C and 6B, so that the probe 248 is in electrical engagement with the center contact of the connector 12. In the case of a relatively long cable, the clamping arm 264 is raised, the cable 10 inserted thereunder, and the clamping arm released. As shown in FIG. 7, air line pressure is 90 PSI and is distributed to the input ports of the air valves 270, 272, 274, and 278 and to a pressure reducer 280 which reduces the pressure to between 44 and 48 PSI. This reduced pressure is distributed to the input port of the air valve 282 and to the piston rod side of the air cylinder 154. A programmable controller 284 is used to monitor the proximity sensors and to generally control the sequence of operation of the air valves 270, 272, 274, 278, and 282. A manually operated start switch 286 is used to activate the controller 284 and begin operation. A manually operated test switch 288 is monitored by the controller 284 and, if set, indicates to the controller 284 that high voltage testing should be automatically performed during the process of attaching the connector to the cable. In the following discussion, the piston rod side of an air cylinder piston will be referred to as the front side of the cylinder and the opposite side will be referred to as the back side.

In beginning the machine operating cycle, the operator sets the test switch 288 as desired and then closes the start switch 286, which in the present example consists of two switches that must be operated simultaneously, one by each hand of the operator. The controller 284, then taking control, actuates the valve 272 routing line pressure to the front side of the cylinder 126, retracting the piston rod and attached rack gear 124 thereby closing the jaws on the cable 10. The controller 284 then actuates the valve 282 routing reduced pressure to the back side of the cylinder 154 causing a 5 pound differential force to extend the piston rod, due to the difference in effective area of the two sides of the piston. As the piston rod extends, it engages the side of the box housing 110 causing it to move the two shafts 102, attached arms 192, 194 and jaws 202, 204 toward the workstation 92. This movement seats the contact 18 and latches it in the connector housing 14. The controller 284 then deactuates the valve 282 allowing the pressure in the front of the cylinder 154 to retract the piston rod. This allows the constant force return spring reel 180 to urge the box housing 110 in the reverse direction thereby applying a two to three pound pull on the contact 18 to assure that it is properly seated within the connector housing. The controller 284 then deactuates the valve 272 removing pressure on the cylinder 126, but leaving the piston rod in its present position so that the jaws 202 and 204 are substantially in their closed position but not in clamping engagement with the outer diameter of the cable 10. The controller 284 then actuates the valve 278 routing line pressure through the valve 282 to the back of the cylinder 154, resulting in a 42 to 46 pound differential force on the cylinder extending the piston rod 158. The piston rod 158 engages the side of the box housing 110 causing it and the jaws 202 and 204 to move toward the workstation 92. As the jaws so move, they slip over the outer surface of the cable 10 but abuttingly engage the end of the ferrule 16 and push it over the braided shield conductor 34 trapping it between the ferrule and the knurled barrel 22. Movement ends when the proximity sensor 152 senses the sensing screw 136. As this movement occurs the two jaws 202 and 204 are prevented from separating by the two guide members 212 on either side of the two arms 192 and 194, as best seen in FIG. 5. The valve 278 is then deactuated by the controller 284 venting the back side of the cylinder 154 causing the piston rod 158 to retract and allowing the cable 186 of the return reel 180 to pull the box housing 110 and the jaws 202 and 204 back to their starting positions. At this point the test switch 288 is examined by the controller 284, and if found to be set in test position, an electrical test is performed, in the present example a high voltage is applied through the test probe 248 to the center contact of the connector 12. If the high voltage does not break down the dielectric the machine cycle continues. The valve 274 is then actuated by the controller 284 venting the pulse valve 290 and applying line pressure to the front side of the cylinder 86 causing the carriage 46 to move to its crimping position with the ferrule within the open crimping dies 56. This position is indicated by the sensor 170. The controller 284 then actuates the valve 270 routing line pressure to the front side of the cylinder 58 causing the piston rod to retract and the crimping bars 54 to close the crimping dies 56 onto the ferrule. After crimping, the valve 270 is reversed by the controller 284 thereby opening the crimping dies 56 and then the valve 274 is reversed to return the carriage 46 to its load position, shown in solid lines in FIG. 6A, which is indicated by the sensor 168. This also routes line pressure to the pulse valve 290 which momentarily pressurizes the back side of the cylinder 126 thereby extending the rack gear 124 to open the jaws 202 and 204 for the next cycle. The high voltage test is again repeated. The cable assembly removed and the cycle repeated as desired.

An important advantage of the present invention is that a number of operations are automatically performed by the machine such as seating the contact, pull testing, sliding the ferrule over the shield conductor, high voltage testing, crimping the ferrule, and again high voltage testing. All of these operations are combined into one machine cycle resulting in a substantial time savings. Additionally, the contact is inserted into the connector housing under a controlled force and is pull tested under another controlled force thereby preventing damage to the parts and increasing yield. Another important advantage is that the very difficult step of manually sliding the ferrule over the braided shield conductor is now done automatically by the machine.

I claim:

1. A machine for attaching an electrical connector to the end of a coaxial cable and then testing the effectiveness of the attachment, said connector having a contact and a ferrule that are preassembled to said cable comprising:

(a) a frame;

(b) crimping apparatus attached to said frame having tooling arranged to crimp a portion of said connector to said cable end;

(c) a carriage coupled to said frame and arranged to move to a first position adjacent said tooling of said crimping apparatus and to a second position away from said tooling;

(d) holding means attached to and carried with said carriage for holding and positioning said connector in position for crimping by said tooling when said carriage is in said first position;

(e) clamping means movable in a first direction toward said holding means substantially parallel with said longitudinal axis of said cable and in a second direction away from said holding means, wherein said clamping means includes a pair of jaws movable to a first position in clamping engagement with said cable for inserting said contact into latching engagement within said connector when said clamping means is moved in said first direction and to test the effectiveness of said latching when moved in said second direction, a second position adjacent the outer periphery of but not clamping said cable for abutting against an end of said ferrule and moving said ferrule into assembled position with respect to said cable and said connector when said clamping means is moved in said first direction, and a third position spaced from said cable; and (f) control means for effecting said movements of said carriage, said clamping means. and said pair of jaws to effect said attachment of said connector to said cable.

2. The machine according to claim 1 including a first air cylinder, wherein when said jaws are in said first position said first air cylinder effects said movement of said clamping means during said inserting of said contact and when said jaws are in said second position said first air cylinder effects said movement of said clamping means during said moving of said ferrule into assembled position.

3. The machine according to claim 2 wherein said first air cylinder is pressurized substantially equally on both sides of its piston during said inserting of said contact.

4. The machine according to, claim 3 wherein both sides of said piston are pressurized from about 40 to about 50 pounds per square inch.

5. The machine according to claim 3 wherein said first air cylinder is pressurized substantially differently on each side of said piston during said movement of said ferrule into assembled position.

6. The machine according to claim 5 wherein said pressure on one side of said piston is between about 80 to about 100 pounds per square inch and said pressure on the other side of said piston is about one half of said pressure on said one side.

7. The machine according to claim 2 wherein said clamping means includes a pair of shafts journaled for rotation in said carriage and being rotationally coupled by means of a pair of mating spur gears, one said spur gear rigidly pinned to each shaft so that when one shaft rotates in one direction the other shaft rotates in the opposite direction, and including a pair of arms, one arm being rigidly attached to each shaft, wherein one of said pair of jaws is attached to one of said arms and the other of said jaws in attached to the other of said arms.

8. The machine according to claim 7 wherein said clamping means includes a second air cylinder coupled to one of said spur gears and arranged so that when one side of said second cylinder is pressurized said pair of shafts move said jaws into said first position and when said one side of said second cylinder is vented after being pressurized said shafts move said jaws into said second position, and when the other side of said second cylinder is pressurized said pair of shafts move said jaws into said third position.

9. The machine according to claim 8 including a member having two holes spaced on the same spacing as said pair of shafts, said two shafts received within said two holes adjacent said arms so that when said jaws are in said first position said member maintains the spacing of said pair of shafts.

10. The machine according to claim 8 wherein said second air cylinder is coupled to said one spur gear by means of a rack gear attached to and carried by the piston rod of said second cylinder.

11. The machine according to claim 7 wherein said clamping means includes a box housing comprising a pair of vertically disposed spaced apart plates, each having two holes spaced on the same spacing as said pair of shafts, said two holes in one plate in alignment with the two holes in the other plate, said pair of shafts being received within said holes in said two plates and extending therethrough, and said pair of spur gears being between said pair of plates, wherein said movement of said clamping means in said first direction toward said holding means is effected by the piston rod of said first air cylinder engaging and pushing against one of said pair of plates.

12. The machine according to claim 11 wherein said clamping means includes a constant force return reel having a cable coupled to said box housing and urging said box housing in said second direction away from said holding means so that when said jaws are in their first position and said piston rod of Said first air cylinder is retracted away from and out of engagement with said box housing, said cable effects movement of said clamping means in said second direction with a substantially constant force.

13. In a method of attaching a coaxial electrical connector to the end of a coaxial cable by means of a machine having a crimping apparatus including tooling arranged to crimp a portion of said connector to said cable end; a carriage arranged to move to a first position adjacent said tooling of said crimping apparatus and to a second position away from said tooling; holding means attached to and carried with said carriage for holding and positioning said connector; clamping means movable in a first direction toward said holding means substantially parallel with said longitudinal axis of said cable and in a second direction away from said holding means, wherein said clamping means includes a pair of movable jaws, the method comprising the steps of:

(1) loading a partially preassembled coaxial connector and coaxial cable assembly into said machine so that said connector is in position within said holding means and said cable is in position between said pair of jaws, Said connector having a housing, said cable having a contact terminal attached to the center conductor thereof and a ferrule positioned on the outer diameter of said cable;

(2) causing said jaws to clampingly engage said cable;

(3) causing said clamping means to move in said first direction to seat and latch said contact in said connector housing;

(4) causing said clamping means to move in said second direction under a specific force to verify proper latching of said contact terminal in said housing;

(5) causing said jaws to disengage their clamping engagement with said cable and to remain closely adjacent to the outer periphery thereof;

(6) causing said clamping means to move in said first direction so that said jaws slide over said cable and abut the end of said ferrule and move said ferrule into position to be crimped;

(7) moving said carriage to said first position adjacent said crimping apparatus so that said ferrule is in crimping position within said tooling; and (8) causing said crimping apparatus to crimp said ferrule onto said cable and said connector housing.

14. The method according to claim 13 including after step (3):

(3a) applying a high voltage to said connector;

(3b) testing for dielectric breakdown of said connector and cable assembly.

15. The method according to claim 13 including after step (8):

(8a) applying a high voltage to said connector;

(8b) testing for dielectric breakdown of said connector and cable assembly.

16. The method according to claim 13 wherein said cable of said partially preassembled coaxial connector and coaxial cable assembly include a center conductor surrounded by a dielectric member surrounded by a shielding conductor, said shielding conductor being flared and positioned partially over a portion of said connector housing, wherein during step (4) said shielding conductor is moved completely over said portion of said connector; and wherein during step (6) said ferrule is moved over said shielding conductor so that said shielding conductor is between said portion of said connector and said ferrule.

* * * * *